United States Patent [19]

Anderson

[11] 4,105,049

[45] Aug. 8, 1978

[54] ABRASIVE RESISTANT CHOKE

[75] Inventor: Clarence E. Anderson, Edmonton, Canada

[73] Assignee: Texaco Exploration Canada Ltd., Calgary, Canada

[21] Appl. No.: 750,788

[22] Filed: Dec. 15, 1976

[51] Int. Cl.[2] ..... F15D 1/02

[52] U.S. Cl. ..... 138/44; 166/91

[58] Field of Search ..... 138/44, 40; 166/91

[56] References Cited

U.S. PATENT DOCUMENTS

| | | | |
|---|---|---|---|
| 2,316,383 | 4/1943 | Abercrombie | 166/91 |
| 2,334,166 | 11/1943 | Allen | 138/44 X |
| 2,407,050 | 9/1946 | Allen et al. | 138/44 |

FOREIGN PATENT DOCUMENTS

| | | | |
|---|---|---|---|
| 1,005,921 | 1/1952 | France | 138/44 |

*Primary Examiner*—William D. Martin, Jr.

*Attorney, Agent, or Firm*—Thomas H. Whaley; Carl G. Ries; Henry C. Dearborn

[57] ABSTRACT

An abrasive resistant choke assembly. It is especially for use in withstanding the abrasive action of sharp particles of silt and sand that are carried by hot fluids flowing under pressure from producing wells. It includes a choke passage with an inlet end that has an angle of taper of less than 8°.

6 Claims, 2 Drawing Figures

ABRASIVE RESISTANT CHOKE

BACKGROUND OF THE INVENTION

1. Field of the Invention

This invention concerns the structure for a choke, in general, and more specifically deals with an improved choke structure that is especially applicable to high pressure fluids containing abrasive materials.

2. Description of the Prior Art

A choke for controlling the pressure of high pressure fluids is basically very simple and well known. However, in the case of fluids which include highly abrasive material particles therein, there have been various proposals for dealing with the abrasive wearing action. Such proposals, insofar as is known, have all accepted the fact of rapid wear and have consequently dealt with the manner of replacing the worn part or parts. Thus, for example, (while it is not a choke, per se) there is a patent concerning a nozzle used for sand blasting purposes that is described in U.S. Pat. No. 2,332,407. That patent deals with the structure for such a nozzle that has replaceable elements in the tapered section of the nozzle, so that the parts may be renewed after wear has taken place. Similarily, there is a U.S. Pat. No.2,407,050 which deals with the structure for a choke. It also is concerned with structure for making the element that is subject to wear replacable after the wearing action has taken place.

Furthermore, there is a known commerical choke structure that is supplied by FMC Corporation, Well Head Equipment Operation, P.O. Box 3091, 1777 Gears Road, Houston, Tex. 77001. That known choke structure includes a multiple stepped reduction in the inside diameter of its interior passageway leading to a small diameter choke passage. In addition, there is some internal threading to accompany an insert that may have a smaller passage. Such an insert is commonly called a choke bean. However, this has been found not to withstand highly abrasive flow under pressure, any better than other known types of commercial chokes. Even ceramic lined positive chokes which are available commerically, have been found not to withstand the abrasion by sharp sand and silt which is flowed by producting wells in an Athabasca tar sands thermal recovery project.

Consequently, it is an object of this invention to provide a choke, and a choke assembly which may be employed in the highly abrasive conditions such as found in flowing wells of an Athabasca tar sand thermal recovery procedure without being "washed-out" in relatively short time and so in need of replacement.

SUMMARY OF THE INVENTION

Briefly, the invention concerns an abrasive resisant choke for use in producing wells and the like. It comprises in combination a high pressure conduit integrally containing a longitudinal passage axially therethrough. The high pressure conduit comprises a constant diameter portion at the outlet end of said passage for providing the desired amount of choking, and a wide mouth tapered portion at the inlet end of said passage for gradually reducing an inlet passage to said constant diameter. The said tapered portion has an angle of taper of less than about eight degrees.

Again briefly, the invention concerns a choke assembly for use on producing wells and the like, which comprises in combination a flow straightening section for carrying said producing well effluent. The flow straightening section comprises a constant inside diameter straight passage therethrough having a length at least ten times said diameter, and high pressure coupling means including a flange welded on the inlet end a removable female threaded union on the outlet end. The choke assembly also comprises a choke section for reducing the pressure of said well effluent. Such choke section comprises a predetermined size constant diameter passage axially located in and extending to the outlet end for providing the desired amount of choking. It also comprises a wide mouth tapered passage at the inlet end for gradually reducing said flow straightening section and having its maximum inside diameter equal to said flow straightening passage inside diameter. The said tapered passage has an angle of taper of about seven degrees. The said choke section is made of machine steel, and it comprises a predetermined length of pipe threads on the ends of said choke section for cooperating with high pressure couplings. The assembly also comprises an expansion section for receiving the effluent from said choke section. Such expansion section comprises a constant diameter conduit having an inside diameter greater than the inside diameter of said flow straightening section, and a flange welded on the outlet end for making high pressure coupling. The expansion section also comprises a high pressure coupling on the inlet end for removably joining the said outlet end of said choke section to said expansion section including a reducer welded to a sleeve having female pipe thread therein for coupling with said choke section pipe threads.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFERRED EMBODIMENT

In producing wells, where the effluent contains abrasive particles therewith and most particularly in connection with a thermal recovery procedure, e.g. in Athabasca tar sands, it has been found that no commercially available choke structures were capable of withstanding the high abrasion resulting from the sharp sand and silt that flowed with such producing wells. Thus, it has been a problem to provide a choke structure which would operate effectively without washing out in a short time due aggravated abrasive action of sharp silt and sand carried by steam, hot water, and bitumem flowing under pressure. For example, the effluent from producing wells and particularly thermal recovery wells. Of course, a choke structure according to this invention would also be effective for any similar conditions in which severe choke abrasion is encountered.

It has been found in the past that all known makes and models of adjustable positive chokes including ceramic lined six inch insert types were incapable of withstanding abrasions by sharp sand and silt which was flowed by producing wells in an Athabasca tar sands thermal recovery project. All of the different chokes that were installed washed out in a few hours, in some instances. Such wash-out sometimes included the body and the flow line after the choke restriction so that well control was eliminated. Such results created an environmental hazard, as well as a safety hazard to personnel.

Figure 1:
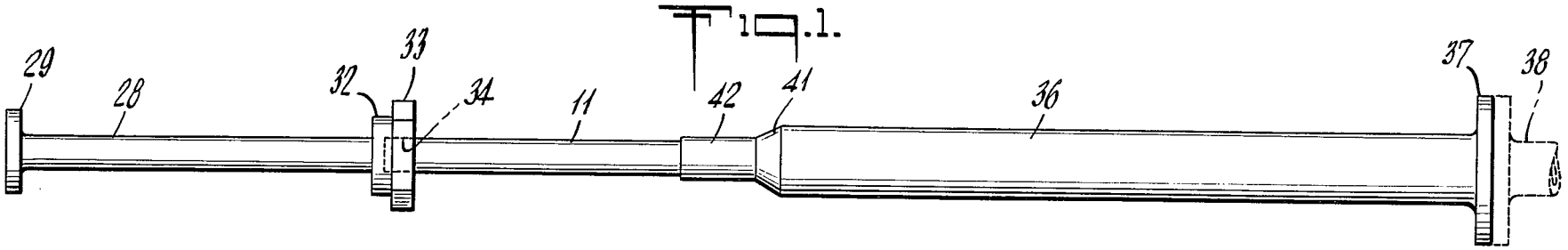
FIG. 1 shows a side elevation of a choke assembly according to the invention.
Figure 2:
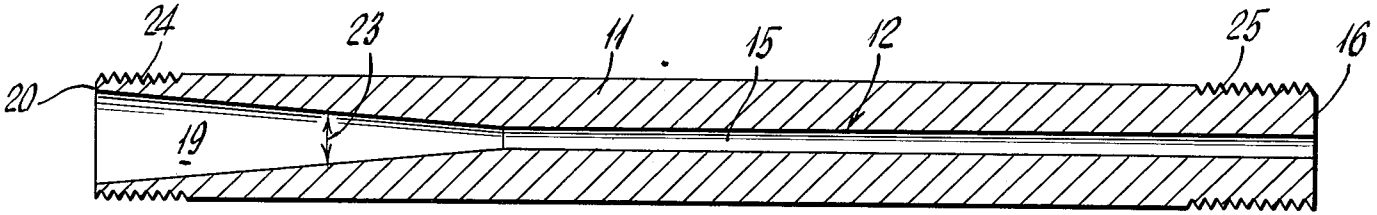
FIG. 2 is a longitudinal cross-section illustrating in an enlarged scale the structure of a choke, per se, according to the invention.

A choke assembly is illustrated in FIG. 1 while the structure of a choke, per se, (in accordance with the invention) is shown in FIG. 2. With reference to FIG. 2 there is shown in longitudinal cross-section a high pressure conduit 11 that is preferably made from hardened machine steel. Furthermore, a preferable type of such material is that designated as 1045 CGP machine steel.

The conduit 11 integrally contains a longitudinal passage 12 that extends axially through the conduit 11 and includes a constant diameter portion 15 that extends to an outlet end 16 of the conduit 11. There is also a wide-mouth tapered portion 19 that extends to an inlet end 20 from a smooth connection with the constant diameter portion 15.

An important feature of the choke structure per se, is the fact that the tapered portion 19 has an angle of taper 23 that is less than 8°. It has been discovered that such a gradual taper is an important aspect of the invention which acts in avoiding the previously destructive abrasive wear of the choke when in use under the indicated conditions.

The conduit 11 is provided with predetermined lengths of pipe threads 24 and 25 on the ends of the conduit 11 for coupling it into the assembly, as will be made clear below.

FIG. 1 illustrates a choke assembly according to the invention. It includes a flow straightening section 28 which has a constant inside diameter straight passage (not shown) therethrough. Its length is at least ten times its diameter. It will be understood that the diameter of this section 28 is the same as the diameter of the open mouth end of tapered portion 19 of the conduit 11.

At the inlet end of the Section 28 there is a high pressure coupling made up of a flange 29 which is welded to the Section 28. At the other end of the Section 28 there is a high pressure coupling 32 which is preferably a union structure of the type that may be tightened by hammer. Thus, there are a plurality of wings or protuberances 33 that extend from the outer circumference thereof. This coupling 32 is a conventional type coupling. It is a rotatable collar and has a female threaded socket interior 34 which matches the pipe threads 24 on the inlet end of the choke conduit 11. It will be understood that there is an integral flange (not shown) on the end of the straightening Section 28, over which the union coupling 32 fits.

There is also an expansion Section 36 of the assembly, shown in FIG. 1. This is a constant inside diameter conduit which has an inside diameter (not shown) that is greater than the inside diameter of the flow straightening Section 28. Also, there is a flange 37 that is welded onto the outlet end of the Section 36 so that it may be used in making a high pressure coupling, as is indicated by the dashed line conduit 38 for continuing the flow.

At the inlet end of the expansion Section 36 there is a high pressure coupling for removable joining it to the choke conduit 11. Such coupling includes a short reducer 41 that is welded to the end of the Section 36, and is also welded to one end of a sleeve 42 that has female pipe threads (not shown) on the interior thereof for coupling with the threads 25 of the choke conduit 11.

It will be observed that there is provided a compact and effective choke assembly. It is so arranged as to be able to removably join a very effective choke structure according to this invention into cooperative conjunction with a flow straightening section and an expansion section of the entire assembly. It has been discovered that this is able to withstand highly abrasive conditions without undue wear on the choke section, and consequently it has provided results that have not been heretofore obtainable.

While a particular embodiment of the invention has been described above in considerable detail in accordance with the applicable statutes, this is not to be taken as in any way limiting the invention but merely as being descriptive thereof.

I claim:

1. A choke assembly for use on producing wells and the like, comprising in combination a flow straightening section for carrying said producing well effluent, comprising a constant diameter straight passage therethrough having a length at least ten times said diameter, and coupling means for the inlet and outlet ends of said straightening section, a choke section for reducing the pressure of said well effluent, comprising a predetermined constant diameter passage at the outlet end for providing the desired amount of choking, a wide mouth tapered passage at the inlet end for gradually reducing said flow straightening section, said tapered passage having an angle of taper of less than about eight degrees and having a maximum diameter the same as said flow straightening section passage, and means for cooperating with said outlet end coupling means of said flow straightening section, and an expansion section for receiving the effluent from said coke section, comprising a constant diameter conduit having an inside diameter greater than the inside diameter of said flow straightening section, and coupling means for removably joining the said outlet end of said choke section to said expansion section.

2. A choke assembly according to claim 1, wherein said tapered passage has an angle of about 7°.

3. A choke assembly according to claim 2, wherein said choke section is made of machine steel.

4. A choke assembly according to claim 3, wherein said choke section means for cooperating comprises a predetermined length of pipe threads, and said choke section also comprises a predetermined length of pipe threads on the other end thereof for cooperating with said expansion section coupling.

5. A choke assembly for use on producing wells and the like, comprising in combination a flow straightening section for carrying said producing well effluent, comprising a constant inside diameter straight passage therethrough having a length at least 10 times said diameter, and high pressure coupling means including a flange welded on the inlet end and a removable female threaded union on the outlet end, a choke section for reducing the pressure of said well effluent, comprising a predetermined size contant diameter passage axially located in and extending to the outlet end for providing the desired amount of choking, a wide mouth tapered passage at the inlet end for gradually reducing said flow straightening section and having its maximum inside diameter equal to said flow straightening passage inside diameter, said tapered passage having an angle of taper of about 7°.

said choke section being made of machine steel, and a predetermined length of pipe threads on the ends of said choke section for cooperating with high pressure couplings, and an expansion section for receiving the effluent from said choke section, comprising a constant diameter conduit having an inside diameter greater than the inside diameter of said flow straightening section, a flange welded on the outlet end for making high pressure coupling, and a high pressure coupling on the inlet end for removably joining the said outlet end of said choke section to said expansion section including a reducer welded to a sleeve having female pipe threads therein for coupling with said choke section pipe threads.

6. A choke assembly for use on producing wells and the like, said assembly having a flow straightening section for carrying said producing well effluent, said straightening section having a constant diameter and an outlet end, said assembly also having an expansion section for receiving the effluent, said expansion section having a constant diameter greater than the diameter of said straightening section and having an inlet end, the improvement, comprising a high pressure conduit integrally containing a longitudinal passage axially therethrough having an inlet end directly coupled to said straightening section outlet end, said longitudinal passage inlet end comprising a wide mouth tapered portion for gradually reducing said straightening section diameter and having an angle of taper of less than about 8°, and said longitudinal passage having an outlet end coupled to said expansion section inlet end.

* * * * *